US008256200B2

(12) United States Patent
Nuesch

(10) Patent No.: US 8,256,200 B2
(45) Date of Patent: Sep. 4, 2012

(54) HIGH-SECURITY CABLE

(75) Inventor: Walter Nuesch, Arnegg (CH)

(73) Assignee: Cortex Humbelin AG, Rupperswill (CH)

( * ) Notice: Subject to any disclaimer, the term of this patent is extended or adjusted under 35 U.S.C. 154(b) by 324 days.

(21) Appl. No.: 12/624,926

(22) Filed: Nov. 24, 2009

(65) Prior Publication Data

US 2010/0064654 A1 Mar. 18, 2010

Related U.S. Application Data

(63) Continuation-in-part of application No. 11/996,328, filed as application No. PCT/CH2006/000292 on Jun. 1, 2006, now abandoned.

(30) Foreign Application Priority Data

Jul. 21, 2005 (CH) ..... 1218/05

(51) Int. Cl.
*D02G 3/22* (2006.01)

(52) U.S. Cl. ..... 57/237; 57/238

(58) Field of Classification Search ..... 57/236–238
See application file for complete search history.

(56) References Cited

U.S. PATENT DOCUMENTS

| | | | | | |
|---|---|---|---|---|---|
| 1,407,378 | A | * | 2/1922 | Callaghan et al. | 57/237 |
| 1,497,068 | A | * | 6/1924 | Collingbourne | 57/237 |
| 1,897,224 | A | * | 2/1933 | Andrews | 57/237 |
| 2,821,835 | A | * | 2/1958 | Berry | 57/237 |
| 3,092,955 | A | * | 6/1963 | Smit | 57/237 |
| 3,206,923 | A | * | 9/1965 | Price | 57/238 |
| 3,291,897 | A | | 12/1966 | Bramley | |
| 3,882,667 | A | | 5/1975 | Barry | |
| 3,950,932 | A | * | 4/1976 | Durling | 57/239 |
| 4,102,118 | A | | 7/1978 | Wheeler | |
| 4,155,394 | A | * | 5/1979 | Shepherd et al. | 152/527 |
| 4,793,130 | A | * | 12/1988 | Togashi et al. | 57/210 |
| 4,877,073 | A | * | 10/1989 | Thise et al. | 152/451 |
| 7,107,751 | B2 | | 9/2006 | Nuesch | |
| 7,305,814 | B2 | | 12/2007 | Nuesch | |

FOREIGN PATENT DOCUMENTS

| | | | |
|---|---|---|---|
| GB | 2036825 | A | 7/1980 |
| WO | WO9222701 | A | 12/1992 |
| WO | WO02084018 | A | 10/2002 |
| WO | WO03048602 | A | 6/2003 |

* cited by examiner

*Primary Examiner* — Shaun R Hurley
(74) *Attorney, Agent, or Firm* — Ziolkowski Patent Solutions Group, SC

(57) ABSTRACT

A high-security cable is provided, wherein the high-security cable is capable of achieving a smoothing of a work-to-break energy curve. The high-security cable is manufactured of a mixture of plastic yarns or of plastic yarns and metal wires, wherein the cable comprises a first constituent part of untwisted or twisted yarns, or untwisted or twisted yarns and metal wires, a second constituent part of doubled yarn, the doubled yarn manufactured of plastic yarns or of plastic yarns and metal wires, and a third constituent part of cord manufactured from the doubled yarns, wherein the doubled yarn is manufactured from plastic yarns or of plastic yarns and metal wires. The high-security cable can be used as a safety arrester cable, and can also be used to form a netting to serve as safety arrester netting or falling-rock protection netting.

21 Claims, 3 Drawing Sheets

HIGH-SECURITY CABLE

The present application is a continuation-in-part of, and claims priority to, U.S. application Ser. No. 11/996,328, filed Apr. 28, 2008, which was a National Stage filing of, and claimed priority to, PCT/CH2006/000292, having an international filing date of Jun. 1, 2006.

BACKGROUND OF THE INVENTION

The present invention relates to a high-security cable, which is manufactured of a mixture of plastic yarns or of plastic yarns and metal wires.

High-security cables are used in many applications. Today, in particular, high-security cables are known, which are used as safety arrester cables, in particular for connecting a wheel of a racing car to its chassis. Such a safety arrester cable is known from WO 03/048602. The mentioned cable consists of a mixed yarn of threads with relatively rigid plastic filaments with an extension until breakage of 2 to 5%, and of relatively elastic plastic filaments with an extension to breakage of 12 to 25%. Here, the various plastic filaments are twisted into yarn strands, wherein the yarn strands are twisted in a balanced manner, whilst the cable manufactured of these yarn strands is twisted in an unbalanced manner. Such a cable not only has large tensile strength, but also an increased extension, by which means one may achieve an improved energy uptake. Given a full loading, the total energy is not transmitted directly to the anchoring, which often represents the critical location in the complete system, thanks to the accordingly increased energy uptake by the cable itself.

The known safety arrester cable, which used in "Formula 1" racing, may only have a relatively short extension path for reasons of safety, in order to prevent the broken-off wheel which now hangs on the arrester cable from being thrown onto the cockpit or the head of the driver. However, a longer extension path would not only be acceptable, but, as the case may be, even desirable with other racing vehicles, or in other applications. The applicant has carried out further research and development in this direction, and has particularly sought after solutions which practically permit the creation of a customer-specific adaptation to the specifications.

Considering the so-called work-to-break-energy curve of any material, then such a curve in principle has the shape of an acute triangle in a coordinate system, with which the force is plotted on the abscissa and the elasticity E on the ordinate. The tensile strength of the material is reflected in the height of the triangle, and the elasticity of the material is represented by the inclination of the hypotenuse of the right-angled triangle. If, then, different materials are processed into a cable, then usually the material-specific peaks are clearly recognisable in the complete enveloping curve. This leads to extremely unfavourable tear behaviour, depending on the load.

It is therefore the object of the present invention to provide a high-security cable which, on account of its special manufacture, is capable of achieving a smoothing of the work-to-break-energy curve, by which means, as a whole, the energy which may be absorbed until breakage is to be increased. This object is achieved by a high-security cable with the features claimed herein. The invention relates also to the use of such a high-security cable for different applications, which until now have not been considered for cable of this type. In particular, the expanded application also results due to the fact that the cables may be manufactured of a combination of filaments of one or more plastics, as well as of wires of one or more metals or metal alloys.

BRIEF DESCRIPTION OF THE INVENTION

The present invention solves the aforementioned problem by providing a high-security cable capable of achieving a smoothing of the work-to-break energy curve.

According to one aspect of the invention, a high-security cable is shown, the high-security cable comprising a first constituent part comprising yarns, wherein the yarns are manufactured using one of a plurality of non-metallic filaments and a combination of non-metallic filaments and metallic wires. The high-security cable further comprises a second constituent part comprising doubled yarns, wherein the doubled yarns are manufactured using the yarns of the first constituent part, and a third constituent part comprising a cord, wherein the cord is manufactured using at least three of the doubled yarns of the second constituent part, and wherein at least one of the doubled yarns is wound differently than the other doubled yarns.

According to another aspect of the invention, a high-security cable is disclosed, the high-security cable comprising a first constituent part comprising yarns, wherein the yarns are manufactured using one of a plurality of non-metallic filaments and a combination of non-metallic filaments and metallic wires, and wherein the metallic wires comprise at least one of nickel wires and austenitic Ni—Cr alloy wires. The high-security cable also comprises a second constituent part comprising doubled yarns, wherein the doubled yarns are manufactured using the yarns of the first constituent part, and wherein the doubled yarns are each wound in both an S-twisted direction and a Z-twisted direction. Furthermore, the high-security cable comprises a third constituent part comprising a cord, wherein the cord is manufactured using at least three of the doubled yarns of the second constituent part, and wherein at least one of the doubled yarns is wound differently than the other doubled yarns.

According to yet another aspect of the invention, a method of forming a high-security cable is shown, the method comprising forming a first constituent part, the first constituent part comprising one of a plurality of plastic yarns or a plurality of plastic yarns and metal wires, and forming a second constituent part, the second constituent part comprising a plurality of doubled yarns formed from the first constituent part, wherein each doubled yarn is wound in one of an S-twisted direction and a Z-twisted direction. The method further comprises forming a third constituent part, the third constituent part comprising a cord manufactured from the plurality of doubled yarns, wherein the cord is formed using both S-twisted doubled yarn and Z-twisted doubled yarn.

Further advantageous designs of the subject-matter of the invention are to be deduced from the dependent claims. Their design, purpose and effect are explained in the subsequent description with reference to the accompanying drawings.

BRIEF DESCRIPTION OF THE DRAWINGS

The drawings illustrate one preferred embodiment presently contemplated for carrying out the invention.

In the drawings.

DETAILED DESCRIPTION OF THE PREFERRED EMBODIMENT

High-security cables in most cases are manufactured of a single material, wherein one usually assumes the greatest force application which is capable of acting on the cable. Until now, one has used two or three different materials in a mixed manner only for reasons such as weather-durability, UV-durability and temperature-durability or other demands of a specific nature. Thereby, one has consistently limited oneself either to textile cables of natural fibres and plastic fibres, or purely metal cables. Cables which consist of both types of fibres and wires in a mixed manner are not obtainable on the market.

Figure 1:
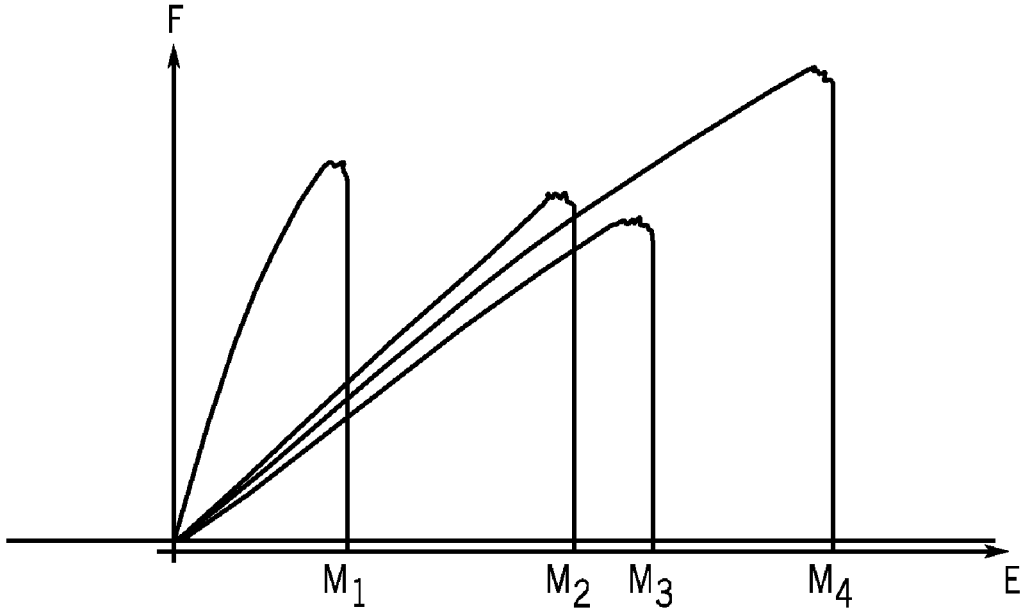
FIG. 1 is a force-extension diagram for various materials, in a symbolic representation.

As is schematically represented in the force-extension diagram of FIG. 1, different materials, which are indicated here as $M_1$, $M_2$, $M_3$ or $M_4$, have different modules of elasticity and different maximal work-to-break capabilities (or work-to-break curves). The respective curves symbolically represent mono-filament or multi-filament cables without twisting, also known as "zero twist" cables. Such curves have a more or less steep flank, a relatively small maximum plateau up to maximal extension, which leads to breakage.

Figure 2:
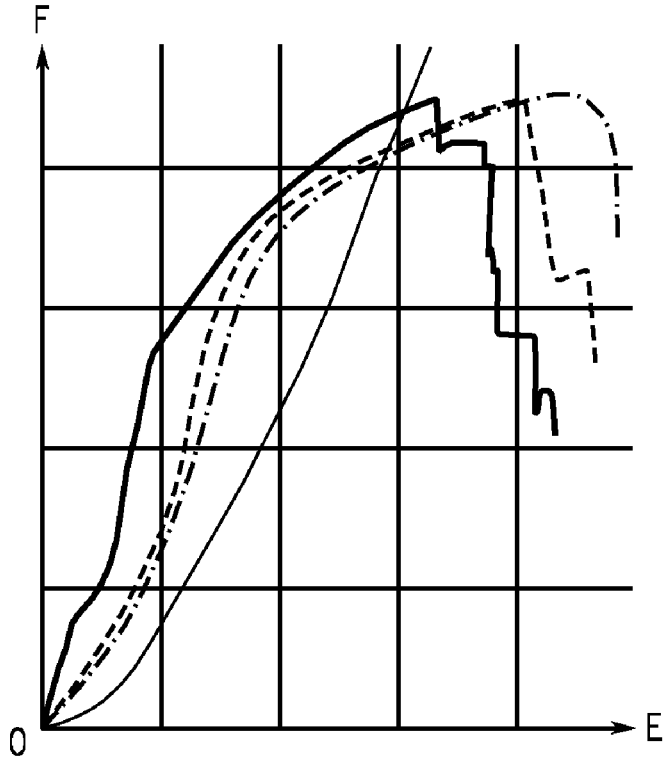
FIG. 2 is a further force-extension diagram of a single material, consisting of yarn, of double yarn and of cord.

FIG. 2, on the other hand, illustrates another force-extension diagram of a cable made up of a single material, wherein the single material is processed into yarns, doubled yarns, and cords. As FIG. 2 clearly shows, the work-to-break curves of the single material processed into yarns, doubled yarns, and cords also have a more or less steep flank, with a relatively small maximum point leading up to maximal extension. Thus, the processing of a single material using multiple processing methods does not greatly affect the cable's maximal extension or breakage point.

In a large series of trials, the applicant has now found that the curves change if instead of a simple yarn in a twisted form or untwisted form, one processes this further into doubled yarns or to cord. With this, it has been found that this form of further processing permits the flank of the gradient curve to become less steep, and, depending on the type of processing, one may maintain the maximal force transmission over a longer extension path. In other words, the previously pointed curves, as are known from FIG. 1, may be stretched out. By way of this, the curves flatten inasmuch as the extension path also increases given an increasing increase of the force, wherein this occurs in the initial phase, as well as further increasing with the maximal force which may be applied. The total work which such a cable is capable of absorbing is represented by the area below the enveloping curve.

However, depending on the application, it may not be desirable to obtain a respective extension already before the maximum force is present. The object of an aspect of the present invention is to be seen in providing a cable which has an as small as possible extension path up to reaching the maximal applicable force, but to permit an as large as possible extension up to breakage when applying the maximal force. The maximal work which may be absorbed may be optimizedin this way.

Figure 3:
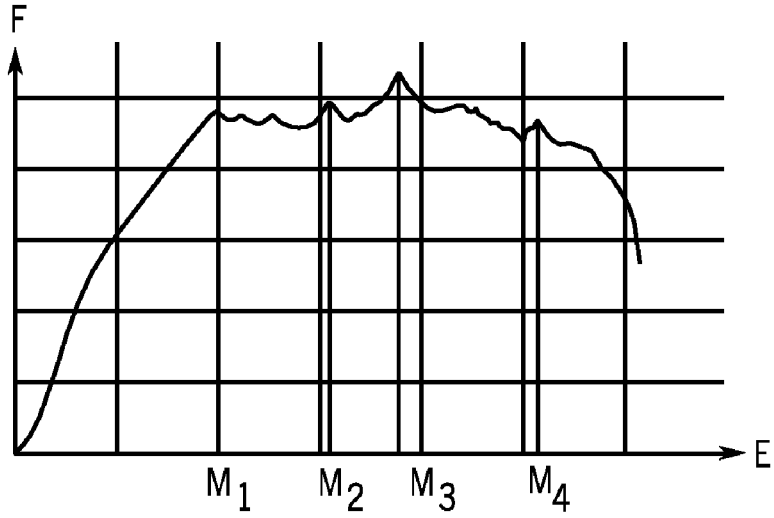
FIG. 3 shows a force-extension diagram of a high-security cable, which is designed according to the invention.

Now, an example is shown by way of the force-extension diagram according to FIG. 3, with which four different materials, symbolised by $M_1$-$M_4$, are processed, wherein all materials are present in the form as a yarn or wires, as well as in the form of doubled yarns, and finally in the form of cord. One may realise a curve which may be symbolically displayed practically as a rectangle, by way of the presence of these materials in all three processed forms, wherein each material does not necessarily have to be present in all three processed forms, although this definitely represents the most optimal design.

Since the definitions of the terms used here are not uniform on an international level, the terms are hereinafter defined as are to be understood in the present invention. The smallest element is a monofilament or a single wire. Here, the fineness of the wire is not fixed. In the present invention, yarn is to be understood as an endless product consisting of several filaments, the filaments being any one of materials $M_1$-$M_4$. Here, the yarn may be non-twisted or twisted. A yarn according to the invention may analogously also consist of a multitude of fine metal wires. These metal wires, too, may be non-twisted or twisted.

Figure 4:
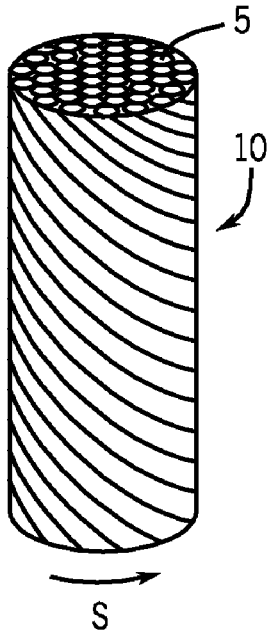
FIG. 4 is a sectional side view of an S-twisted doubled yarn according to an embodiment of the invention.
Figure 5:
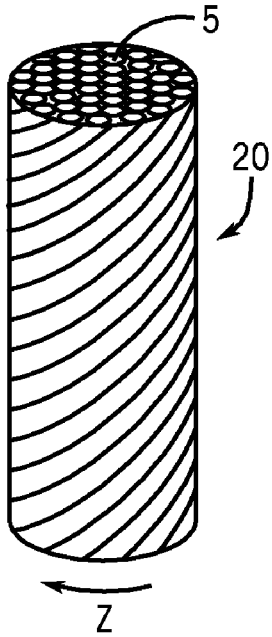
FIG. 5 is a sectional side view of a Z-twisted doubled yarn according to an embodiment of the invention.

With regard to the invention, a doubled yarn is to be understood as a product which consists of two yarns which are wound with one another. Each doubled yarn may be S-twisted or Z-twisted. Here, S-twisting is to be understood as a left-hand twisting, illustrated in FIG. 4, and Z-twist is to be understood as a right-hand twisting, illustrated in FIG. 5. As FIGS. 4 and 5 respectively show, the S-twisted doubled yarn 10 and Z-twisted doubled yarn 20 each comprise a plurality of filaments 5, wherein each filament 5 may be any one of materials $M_1$-$M_4$.

Figure 6:
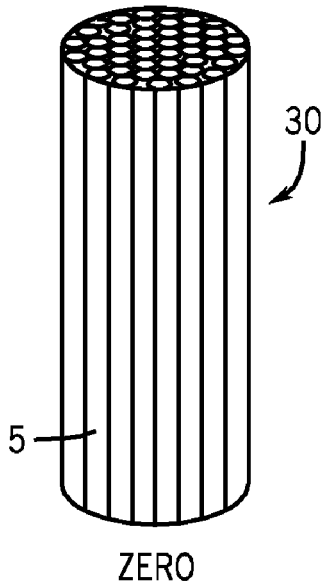
FIG. 6 is a sectional side view of a zero-twisted doubled yarn according to an embodiment of the invention.

Alternatively, a doubled yarn may also be an untwisted, or "zero twist", doubled yarn, as is shown by zero-twisted doubled yarn 30 in FIG. 6. Like S-twisted doubled yarn 10 and Z-twisted doubled yarn 20, zero-twisted doubled yarn 30 comprises a plurality of filaments 5. As the zero-twisted doubled yarn 30 is not twisted, each of the filaments 5 are arranged in parallel to the longitudinal axis of doubled yarn 30. Such a configuration enables zero-twisted doubled yarn 30 to use 100% of the potential strength of filaments 5 when subjected to a pulling force. Conversely, if S-twisted doubled yarn 10 and/or Z-twisted doubled yarn 20 were directly subject to such an axial pulling force, the full potential strength of filaments 5 could not be used, as the pulling force would be divided into two directional components according to twisting angle of the twisted filaments. However, while zero-twisted doubled yarn 30 may provide optimal strength when subjected to an axial load, the stability of the shape of the resulting cable formed from zero-twisted doubled yarn 30 is low in the absence of an external wrapping or sleeve formed around the zero-twisted doubled yarn 30 to contain the filaments 5.

With regard to the present invention, a cord is to be understood as a product with which at least three doubled yarns are twisted into a cord. It has been found that such a cord advantageously comprises three doubled yarns, wherein at least one doubled yarn is wound differently than the two other doubled yarns. Thus, one produces cords which, for example, are manufactured of two S-twisted doubled yarns and a Z-twisted doubled yarn, or of two Z-twisted doubled yarns and one S-twisted doubled yarn.

Figure 7:
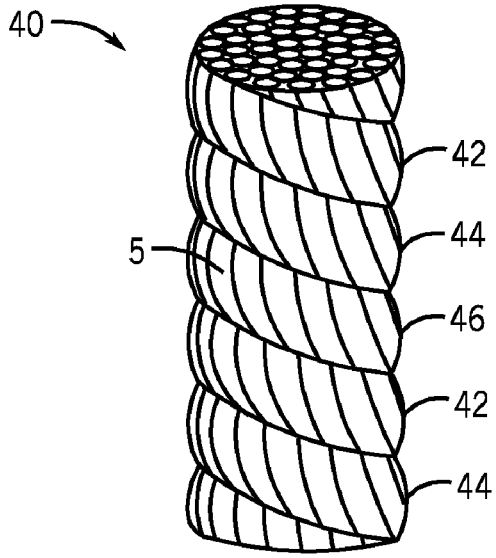
FIG. 7 is a sectional side view of a cord formed in accordance with an embodiment of the invention.

FIG. 7 illustrates a cord according to an embodiment of the present invention. Cord 40 shown in FIG. 7 comprises a first doubled yarn 42, a second doubled yarn 44, and a third doubled yarn 46. Each doubled yarn 42-46 comprises a plurality of filaments 5, as discussed above with respect to FIGS. 5 and 6. The respective doubled-yarns 42-46 may either be S-twisted or Z-twisted doubled yarns, but it is desired that some combination of S-twisted and Z-twisted doubled yarns be used to form cord 40. For example, first doubled yarn 42 may be an S-twisted doubled yarn, second doubled yarn 44 may be a Z-twisted doubled yarn, and third doubled yarn 46 may be another S-twisted doubled yarn. However, it is to be understood that such a configuration is merely exemplary, and the present invention is not limited as such.

As can further be seen in FIG. 7, the combination of various S-twisted doubled yarns and Z-twisted doubled yarns 42-46 are twisted to form cord 40 such that the plurality of filaments 5 are arranged in parallel to the longitudinal axis of cord 40. Accordingly, the full potential strength of filaments 5 can be used when cord 40 is subject to an axial load, similar to the zero-twisted doubled yarn 30 discussed above with respect to FIG. 6. However, unlike zero-twisted doubled yarn 30, cord 40 comprises a plurality of twisted doubled yarns, and therefore the stability of the shape of cord 40 is much higher than that of a zero-twisted doubled yarn. Thus, no external wrapping is needed for cord 40 to retain its shape and contain the plurality of filaments 5.

The individual yarns not only vary in the twist direction in which they are twisted, but they also differ in the number of twists per meter. This measure number may vary in the magnitude from about 30 twists per meter up to maximally 600 twists per meter. Whilst the S-twisting or the Z-twisting may be used independently of the type of material, the variation of the twists per meter may be dependent on different factors, such as, for example, the stiffness of the materials and of course on the effect to be achieved. Basically it is the case that the lower the twisting, the lower is the extension path until breakage, wherein, however, one should additionally take into account the fact that although the extension path until breakage increases with a very large number of twists per meter, the maximal force until breakage is however reduced. The latter is particularly the case with yarns which are completely manufactured of metal, or for yarns which contain a metal component.

As already mentioned, the cords according the present invention advantageously comprise three doubled yarns. Thereby, within a cord, the variation of the yarns applied therein, with regard to the properties of the materials, as well as with regard to the number of twists per meter, should not be too great.

With regard to the materials being considered here, one may essentially ignore the purely natural fibres. Apart from the known carbon fibres with tensile strength of 20 cN/dtex, the essentially more elastic m-aramide fibres which have a tensile strength of 4.7 cN/dtex are of course also considered here. The mentioned elastic m-aramide fibres may also be combined very well with the relatively rigid p-aramide fibres, which have a tensile strength of 19 cN/dtex. The very modern PBP-fibres, which even have a tensile strength of about 37 cN/dtex, have a particularly high tensile strength. Cables which are manufactured of such high tensile fibres are capable of accommodating tensile forces which far exceed the usually occurring forces. Despite this, often such high-security cables which are manufactured of such high tensile materials are extremely problematic on application. The smallest elastic extension up to breakage of only 1.5 to maximal 3.5% limits their application. The cables must be able to absorb a part of the energy via the extension, wherever very high forces may occur during a relatively short period of time, since otherwise the occurring brief, enormously high forces only lead to a destruction of the fastening points of the cables. Even then, when these fastening points are able to be dimensioned significantly greater than the cables in many cases, according to experience, problems occur at the fixation points.

In order to increase the deformation work which is undergone by the cable, the admixture of metal wires which may be integrated either in the yarn or the cord, in particular by way of a so-called core-spinning method, is particularly suitable, wherein the metal wire or wires lie in the centre, whilst the plastic yarns run around the metal wire or wires. With regard to the metal wires of interest here, of course various steel wires are to be considered, but in particular also wires of nickel or of an austenitic nickel-chrome alloy have proven their worth. Austenitic nickel-chrome alloys were processed in the form of wires with a diameter of below 0.5 mm into doubled yarns, and these processed further into a cable with a diameter of 12 to 13 mm. Such a cable with a length of 600 mm permits the transmission of a maximal force of 57.8 kN. The work-to-break here was also 10,000 Nm.

What is essential according to the present invention, is the fact that the cable must consist of three different constituent parts, specifically on the one hand of yarns, on the other hand of doubled yarns, and thirdly of cords, wherein simultaneously, of each material constituent part, this material should be present as yarn as well as doubled yarn and as cord. Only thus is it ensured that the three different extension regions of the same material may also be utilised.

It is only due to the combination of all three processing steps that the maximal extendibility of the material is also fully utilised. Although the processing of metal wires in the high-security cable according to the invention is not absolutely necessary, such wires have been found to be extremely advantageous for covering certain extension ranges. In the case that the high-security cable contains shares of p-aramide fibres, m-aramide fibres, or PBO-fibres, then the share of these fibres which have a tensile strength of more than 10 cN/dtex energy generally consist mostly of the constituent parts of yarn and cord, but to a lesser extent as pure cord.

The application of such high-security cables according to the invention is hardly suitable for cables which merely need to transmit a relatively constant high tensile force. However, the high-security cables according to the invention may be applied wherever extreme high peak loads of a high-security cable occur. In particular, tests have shown that such safety arrester cables are suitable for application in sports car racing, for connecting a wheel to the chassis of the racing car. It has been found that with such an application, it makes sense to design the cable according to the invention such that several windings are shaped into parallel loops, so that at least one open loop is formed at the open end.

Figure 8:
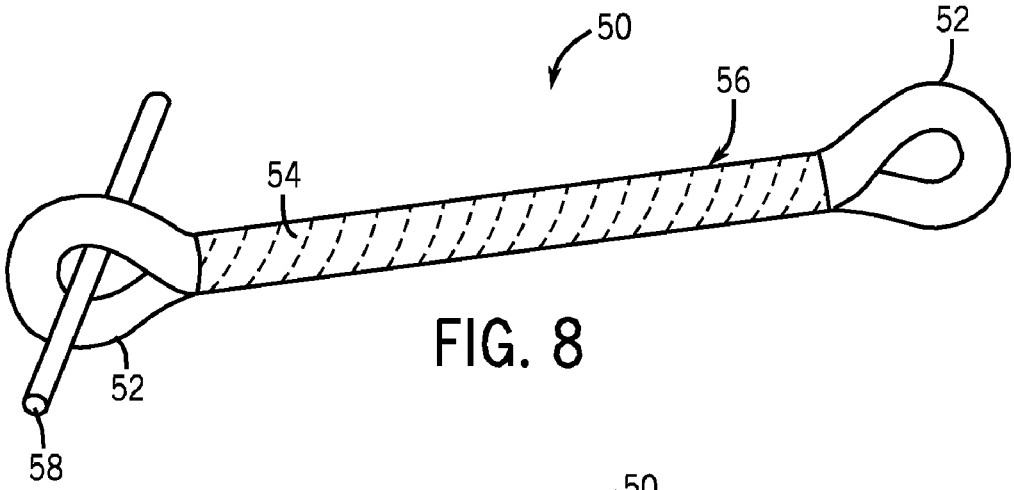
FIG. 8 is a perspective view of a high-security cable formed in accordance with an embodiment of the present invention.
Figure 9:
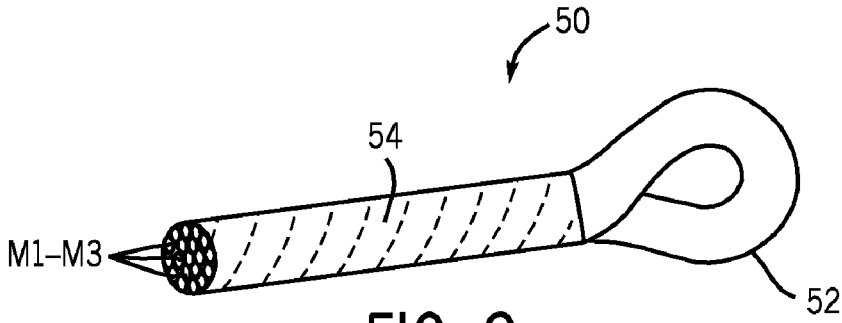
FIG. 9 is a cut-away perspective view of the high-security cable of FIG. 8.

FIGS. 8 and 9 illustrate such a cable having at least one open loop formed at an open end. As FIG. 8 shows, a high-security cable 50 comprises two loops 52 formed at the respective ends of high-security cable 50. High-security cable 50 is made up of a plurality of twisted filaments 54 which, as disclosed above, are processed to form a combination of yarns, doubled yarns, and cord in accordance with the present invention. The region of high-security cable 50 that is located between loops 52 may be covered by a sleeve or wrapping 56, thereby providing protection to the plurality of filaments 54 which make up high-security cable 50. The loops 52 may also be configured to surround and/or engage at least one fitting member 58.

FIG. 9 illustrates a cut-away portion of high-security cable 50 according to an aspect of the present invention. Again, a loop 52 is formed at one end of high-security cable 50, which is made up of a plurality of twisted filaments 54. The respective filaments 54 are formed of a plurality of different materials $M_1$-$M_3$, each material having its own work-to-break energy characteristics to enable high-security cable 50 to increase the energy which may be absorbed as a whole until breakage of any of the filaments formed of materials $M_i$-$M_3$.

A further field of application of these cables according to the invention lies in the fact that these may be used in order to make safety arrester cables therefrom, which may be attached along ski slopes, and in particular along the race circuits in alpine sports.

High-security cables may only fulfil the safety standards demanded of them when these are applied under clear conditions. Accordingly, they are hardly suitable for long-term falling-stone arrester structures or avalanche protective structures. The prevailing environmental influences over a longer period would manifest themselves with regard to the performance of the high-security cable. However, the high-security cables may be advantageously be processed into nettings which may serve as a temporary avalanche protector netting. Accordingly, such cables may also be processed into nettings as temporary falling-stone arrester netting.

The present invention has been described in terms of the preferred embodiment, and it is recognized that equivalents, alternatives, and modifications, aside from those expressly stated, are possible and within the scope of the appending claims.

Thus, according to one aspect of the invention, a high-security cable is shown, the high-security cable comprising a first constituent part comprising yarns, wherein the yarns are manufactured using one of a plurality of non-metallic filaments and a combination of non-metallic filaments and metallic wires. The high-security cable further comprises a second constituent part comprising doubled yarns, wherein the doubled yarns are manufactured using the yarns of the first constituent part, and a third constituent part comprising a cord, wherein the cord is manufactured using at least three of the doubled yarns of the second constituent part, and wherein at least one of the doubled yarns is wound differently than the other doubled yarns.

According to another aspect of the invention, a high-security cable is disclosed, the high-security cable comprising a first constituent part comprising yarns, wherein the yarns are manufactured using one of a plurality of non-metallic filaments and a combination of non-metallic filaments and metallic wires, and wherein the metallic wires comprise at least one of nickel wires and austenitic Ni—Cr alloy wires. The high-security cable also comprises a second constituent part comprising doubled yarns, wherein the doubled yarns are manufactured using the yarns of the first constituent part, and wherein the doubled yarns are each wound in both an S-twisted direction and a Z-twisted direction. Furthermore, the high-security cable comprises a third constituent part comprising a cord, wherein the cord is manufactured using at least three of the doubled yarns of the second constituent part, and wherein at least one of the doubled yarns is wound differently than the other doubled yarns.

According to yet another aspect of the invention, a method of forming a high-security cable is shown, the method comprising forming a first constituent part, the first constituent part comprising one of a plurality of plastic yarns or a plurality of plastic yarns and metal wires, and forming a second constituent part, the second constituent part comprising a plurality of doubled yarns formed from the first constituent part, wherein each doubled yarn is wound in one of an S-twisted direction and a Z-twisted direction. The method further comprises forming a third constituent part, the third constituent part comprising a cord manufactured from the plurality of doubled yarns, wherein the cord is formed using both S-twisted doubled yarn and Z-twisted doubled yarn.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A high-security cable comprising:

a first constituent part comprising yarns, wherein the yarns are manufactured using one of a plurality of non-metallic filaments and a combination of non-metallic filaments and metallic wires;

a second constituent part comprising doubled yarns, wherein the doubled yarns are manufactured using the yarns of the first constituent part; and a third constituent part comprising a cord, wherein the cord is manufactured using at least three of the doubled yarns of the second constituent part, and wherein at least one of the doubled yarns is wound differently than the other doubled yarns; and wherein the plurality of non-metallic filaments have a minimum tensile strength of 10 cN/dtex.

2. The high-security cable of claim 1 wherein the metallic wires are present in each constituent part.

3. The high-security cable of claim 2 wherein the metallic wires are integrated into the yarn by way of a core-spinning method.

4. The high-security cable of claim 1 wherein the non-metallic filaments comprise at least one of carbon fibres, p-aramide fibres, m-aramide fibres and PBO fibres.

5. The high-security cable of claim 1 wherein the doubled yarns are wound using one of an S-twist and a Z-twist.

6. The high-security cable of claim 1 wherein the yarns have minimum of 30 twists per meter and a maximum of 600 twists per meter.

7. The high-security cable of claim 1 wherein the cable is configured as a safety arrester cable to connect a wheel of a racing car to its chassis.

8. The high-security cable of claim 1 wherein the cable is configured as a safety arrester cable to be attached along a ski slope.

9. The high-security cable of claim 1 wherein the cable further comprises a plurality of windings of loops closed in parallel such that at least one open tab is formed at both ends of the cable.

10. A high-security cable comprising:

a first constituent part comprising yarns, wherein the yarns are manufactured using a plurality of non-metallic filaments;

a second constituent part comprising doubled yarns, wherein the doubled yarns are manufactured using the yarns of the first constituent part, and wherein the doubled yarns are each wound in an S-twisted direction or a Z-twisted direction;

a third constituent part comprising a cord, wherein the cord is manufactured using at least three of the doubled yarns of the second constituent part, and wherein at least one of the doubled yarns is wound differently than the other doubled yarns; and at least one metallic wire integrated in one of the first constituent part and the third constituent part.

11. The high-security cable of claim 10 wherein the at least one metallic wire comprises at least one of a nickel wire and an austenitic Ni-Cr alloy wire.

12. The high-security cable of claim 10 wherein the non-metallic filaments comprise at least one of carbon fibres, p-aramide fibres, m-aramide fibres and PBO fibres.

13. The high-security cable of claim 10 wherein the yarns have minimum of 30 twists per meter and a maximum of 600 twists per meter.

14. The high-security cable of claim 10 wherein the cable further comprises a plurality of windings of loops closed in parallel such that at least one open tab is formed at both ends of the cable.

15. The high-security cable of claim 14 wherein the cable further comprises a protective sleeve surrounding the cable between the at least one open tab at both ends of the cable.

16. A method of forming a high-security cable, the method comprising:

forming a first constituent part, the first constituent part comprising a plurality of plastic yarns;

forming a second constituent part, the second constituent part comprising a plurality of doubled yarns formed from the first constituent part, wherein each doubled yarn is wound in one of an S-twisted direction and a Z-twisted direction;

forming a third constituent part, the third constituent part comprising a cord manufactured from the plurality of doubled yarns, wherein the cord is formed using both S-twisted doubled yarn and Z-twisted doubled yarn; and integrating a metal wire into one of the first constituent part and the third constituent part.

17. The method of claim 16 wherein forming the first constituent part comprises twisting the plastic yarns to a minimum of 30 twists per meter and a maximum of 600 twists per meter.

18. The method of claim 16 further comprising integrating the metal wires into the first constituent part by way of a core-spinning method.

19. The method of claim 16 further comprising forming a plurality of windings of loops closed in parallel such that at least one open tab is formed at both ends of the cable.

20. The method of claim 16 wherein forming the third constituent part comprises forming the cord using three of the doubled yarns of the second constituent part, and wherein at least one of the doubled yarns is twisted differently than the other doubled yarns.

21. A high-security cable comprising:

a first constituent part comprising yarns, wherein the yarns are manufactured using one of a plurality of non-metallic filaments and a combination of non-metallic filaments and metallic wires;

a second constituent part comprising doubled yarns, wherein the doubled yarns are manufactured using the yarns of the first constituent part;

a third constituent part comprising a cord, wherein the cord is manufactured using at least three of the doubled yarns of the second constituent part, and wherein at least one of the doubled yarns is wound differently than the other doubled yarns; and wherein the metallic wires are present in each constituent part.

* * * * *